US008362858B2

(12) United States Patent
Kurasawa

(10) Patent No.: US 8,362,858 B2
(45) Date of Patent: Jan. 29, 2013

(54) ELECTROMAGNETIC SWITCH

(75) Inventor: Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/279,577

(22) Filed: Oct. 24, 2011

(65) Prior Publication Data

US 2012/0105179 A1 May 3, 2012

(30) Foreign Application Priority Data

Oct. 28, 2010 (JP) ..... 2010-241607

(51) Int. Cl.
*H01H 67/02* (2006.01)

(52) U.S. Cl. ..... 335/126; 335/131

(58) Field of Classification Search ..... 335/131, 335/126
See application file for complete search history.

(56) References Cited

U.S. PATENT DOCUMENTS

| | | | | |
|---|---|---|---|---|
| 7,772,944 | B2 * | 8/2010 | Kurasawa et al. | 335/126 |
| 2009/0183595 | A1 | 7/2009 | Niimi | |
| 2010/0264765 | A1 * | 10/2010 | Haruno et al. | 310/71 |

FOREIGN PATENT DOCUMENTS

| | | |
|---|---|---|
| JP | U-60-102469 | 7/1985 |
| JP | A-2010-230013 | 10/2010 |

* cited by examiner

*Primary Examiner* — Elvin G Enad
*Assistant Examiner* — Lisa Homza
(74) *Attorney, Agent, or Firm* — Oliff & Berridge, PLC

(57) ABSTRACT

An electromagnetic switch includes an electromagnetic coil, a fixed core, a movable core, and a diode. The electromagnetic coil is configured to form an electromagnet when energized. The fixed core is arranged to be magnetized by the electromagnet. The movable core is arranged to be attracted by the magnetized fixed core to move in a movement direction toward the fixed core. The diode is electrically connected in parallel with the electromagnetic coil. The diode includes a main body and has a pair of leads respectively extending from a pair of ends of the main body which are opposite to each other in a lead arrangement direction of the diode. The lead arrangement direction of the diode is parallel to the movement direction of the movable contact.

5 Claims, 4 Drawing Sheets

ELECTROMAGNETIC SWITCH

CROSS-REFERENCE TO RELATED APPLICATION

This application is based on and claims priority from Japanese Patent Application No. 2010-241607, filed on Oct. 28, 2010, the content of which is hereby incorporated by reference in its entirety into this application.

BACKGROUND OF THE INVENTION

1. Technical Field of the Invention

The present invention relates generally to electromagnetic switches, and more particularly to electromagnetic switches for engine starters of motor vehicles.

2. Description of the Related Art

There is known a conventional electromagnetic switch for controlling supply of electric power to an electric motor in an engine starter of a motor vehicle (see, for example, Japanese Utility Model Application Publication No. S60-102469).

Specifically, the conventional electromagnetic switch includes an electromagnetic coil, a movable core, a pair of fixed contacts, and a movable contact. The fixed and movable contacts together make up main contacts of a motor circuit for supplying electric power to the motor.

In operation, when the electromagnetic coil is energized, the movable core is attracted by a magnetic attraction, which is created by the energization of the electromagnetic switch, to move the movable contact, thereby causing the movable contact to bridge or electrically connect the fixed contacts. As a result, the main contacts of the motor circuit are closed so that electric power is supplied from a battery to the motor.

Further, when the energization of the electromagnetic coil is interrupted, the magnetic attraction disappears, causing the movable core and the movable contact to return to their initial rest positions. Consequently, the fixed contacts are electrically disconnected. As a result, the main contacts of the motor circuit are opened so that the supply of electric power to the motor is interrupted.

Moreover, it is also known that in such a conventional electromagnetic switch as described above, when the energization of the electromagnetic coil (or the supply of electric power to the electromagnetic coil) is interrupted by an energization interrupting means, some damage may be made to the energization interrupting means due to the inductance of the electromagnetic coil.

In particular, in the case of the energization interrupting means being made up of an electric relay that includes a pair of fixed contacts and a movable contact, an electric arc may be generated between the fixed contacts and the movable contact when the electric relay interrupts the energization of the electromagnetic coil, thereby causing wear of the fixed and movable contacts.

Furthermore, in recent years, idling stop systems (or stop-start systems) have come to be used in motor vehicles for improving the fuel economy. For an engine starter used in a motor vehicle that is equipped with an idling stop system, the number of times the engine starter starts the engine of the vehicle is dramatically increased in comparison with an engine starter used in a motor vehicle without an idling stop system. Therefore, for the electromagnetic switch used in such as an engine starter, it is particularly important to ensure high durability of the energization interrupting means.

To solve the above problem, Japanese Utility Model Application Publication No. S60-10246 discloses a technique according to which: a diode is electrically connected in parallel with the electromagnetic coil of the electromagnetic switch, with its anode arranged to be lower in electric potential than its cathode. Consequently, when the energization of the electromagnetic coil is interrupted by the energization interrupting means, at least part of the electric current, which is caused by the inductance of the electromagnetic coil, can be made to circulate within a closed circuit formed by the electromagnetic coil and the diode, thereby minimizing the amount of the electric current flowing to the energization interrupting means.

Moreover, in a motor vehicle, the engine starter is generally directly fixed to the engine of the vehicle. Therefore, the electromagnetic switch used in the engine starter is generally subject to high vibration. Further, when the diode is disposed within the electromagnetic switch, the diode may receive a mechanical shock which is caused by the movement of the movable core in the axial direction of the electromagnetic switch. Therefore, it is desired to reliably protect the diode from the mechanical shock.

SUMMARY OF THE INVENTION

According to an embodiment, there is provided an electromagnetic switch which includes an electromagnetic coil, a fixed core, a movable core, and a diode. The electromagnetic coil is configured to form an electromagnet when energized. The fixed core is arranged to be magnetized by the electromagnet. The movable core is arranged to be attracted by the magnetized fixed core to move in a movement direction toward the fixed core. The diode is electrically connected in parallel with the electromagnetic coil. The diode includes a main body and has a pair of leads respectively extending from a pair of ends of the main body which are opposite to each other in a lead arrangement direction of the diode. The lead arrangement direction of the diode is parallel to the movement direction of the movable contact.

With the above configuration, when the movable core makes contact with the fixed core and thereby causes a mechanical shock to be applied to the diode, the load imposed on the main body of the diode and the leads due to the mechanical shock will be small. Consequently, it is possible to reliably prevent the diode from being damaged by the mechanical shock.

In further implementations, the electromagnetic switch may further include a bobbin that includes a main body, around which the electromagnetic coil is wound, and a diode mounting portion to which the diode is mounted.

Further, the main body of the bobbin may be arranged, on one side of the fixed core in the movement direction of the movable core, in abutment with the fixed core. The fixed core may have a through-hole that is formed to penetrate the fixed core in the movement direction of the movable core. The diode mounting portion of the bobbin may be formed to extend in the movement direction of the movable core from the main body of the bobbin to the other side of the fixed core through the through-hole of the fixed core.

It is preferable that at least one of the leads is fixed to the movable core.

It is further preferable that: both the leads are fixed to the movable core; and each of the leads has a bent portion, which is bent from the lead arrangement direction of the diode to a direction perpendicular to the lead arrangement direction, and a fixed portion that extends from the bent portion and is fixed to the fixed core.

BRIEF DESCRIPTION OF THE DRAWINGS

The present invention will be understood more fully from the detailed description given hereinafter and from the accompanying drawings of one preferred embodiment of the invention, which, however, should not be taken to limit the invention to the specific embodiment but are for the purpose of explanation and understanding only.

In the accompanying drawings.

DESCRIPTION OF PREFERRED EMBODIMENT

Figure 1B:
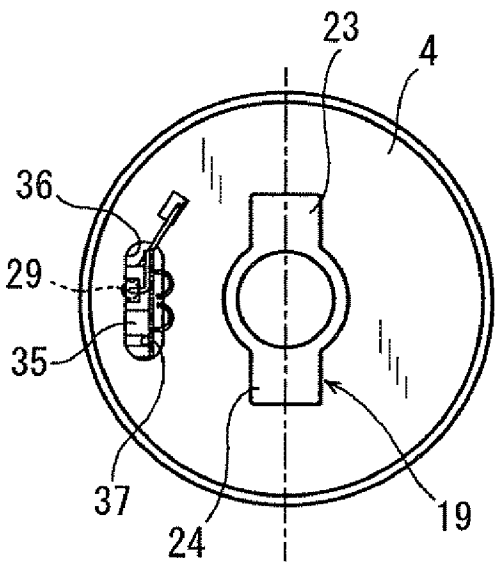
FIG. 1B is an end view of the electromagnetic switch in a direction as indicated with the arrow A in FIG. 1A, omitting a contact cover of the electromagnetic switch.

FIG. 1 shows the overall configuration of an electromagnetic switch 1 according to an embodiment of the invention.

In this embodiment, the electromagnetic switch 1 is designed to be used in a starter for starting an engine of a motor vehicle. More specifically, in the starter, the electromagnetic switch 1 functions to selectively open and close main contacts (to be described later) of a motor circuit for supplying electric power from a battery 70 to an electric motor 80 (see FIG. 4); it also functions to drive a shift lever (not shown) so as to shift a pinion gear in a direction to mesh with a ring gear of the engine.

As shown in FIG. 1, the electromagnetic switch 1 includes a switch case 2, an electromagnetic coil 3, a fixed core 4, a movable core 5, the main contacts of the motor circuit, and a contact cover 6.

The switch case 2 has the shape of a substantially cylindrical cup. The switch case 2 forms part of a magnetic circuit for passing a magnetic flux that is created by energization of the electromagnetic coil 3.

The electromagnetic coil 3 is configured so that when a coil energization switch 60 (see FIG. 4) is closed, the coil 3 is energized by electric power supplied from the battery 70, forming an electromagnet. The electromagnetic coil 3 is wound around a resin-made cylindrical bobbin 10, and disposed within the switch case 2 together with the bobbin 10.

The fixed core 4 has the shape of a circular plate. The fixed core 4 is arranged within the switch case 2 so as to be close to the open end of the switch case 2 and on the right side of the bobbin 10 in the axial direction of the switch case 2. The fixed core 4 is made of a ferromagnetic material (e.g., iron) that is magnetized by the magnetic flux created by the electromagnet (or by the energization of the electromagnetic coil 3). The fixed core 4 forms the magnetic circuit together with the switch case 2. Moreover, the fixed core 4 has a center hole 11 that is formed at a radially center portion of the fixed core 4 so as to penetrate the fixed core 4 in the axial direction (or in the thickness direction of the fixed core 4).

The movable core 5 is arranged radially inside of the electromagnetic coil 3 so as to face the fixed core 4 in the axial direction from the left side and be movable in the axial direction. That is, the movement direction of the movable core 5 coincides with the axial direction of the switch case 2.

With the above arrangement, the movable core 5 can be attracted, by the fixed core 4 that is magnetized by the magnetic flux created by the energization of the electromagnetic coil 3, to move rightward (or toward the fixed core 4). Moreover, the movable core 5 is urged leftward (or in the axial direction away from the fixed core 4) by a return spring (not shown).

To the right end of the movable core 5, there is fixed a shaft 12. On the other hand, to the left end of the movable core 5, there is fixed a shift rod 13 that is connected to the shift lever (not shown). In addition, the shift rod 13 has its left end protruding outside of the switch case 2 through a through-hole (not shown) that penetrates the bottom wall of the switch case 2.

The shaft 12 extends in the axial direction of the switch case 2 through the center hole 11 of the fixed core 4, so as to have its right end located inside a contact chamber 16 formed in the contact cover 6.

The contact cover 6 is made of, for example, resin and has the shape of a substantially cylindrical cup. The contact cover 6 is fixed to the right end of the switch case 2 by crimping, with the fixed core 4 sandwiched (or fixed) between the right end of the bobbin 10 and the left end of the contact cover 6. Consequently, the hollow space formed in the contact cover 6 is enclosed by the side and bottom walls of the contact cover 6 and the fixed core 4. The hollow space makes up the contact chamber 16 for receiving the main contacts of the motor circuit.

In addition, it should be noted that in the present embodiment, the axial direction of the contact cover 6 coincides with the axial direction of the switch case 2.

The main contacts of the motor circuit are made up of a pair of first and second fixed contacts 17 and 18 and a movable contact 19. The first fixed contact 17 is electrically connected to the battery 70, while the second fixed contact 18 is electrically connected to the motor 80 (see FIG. 4). The movable contact 19 is configured to selectively connect and disconnect the first and second fixed contacts 17 and 18.

The movable contact 19 is mounted to the right end of the shaft 12 via an insulator. Further, the movable contact 19 is urged rightward by a spring 22 that is interposed between the movable core 5 and the movable contact 19.

Figure 1A:
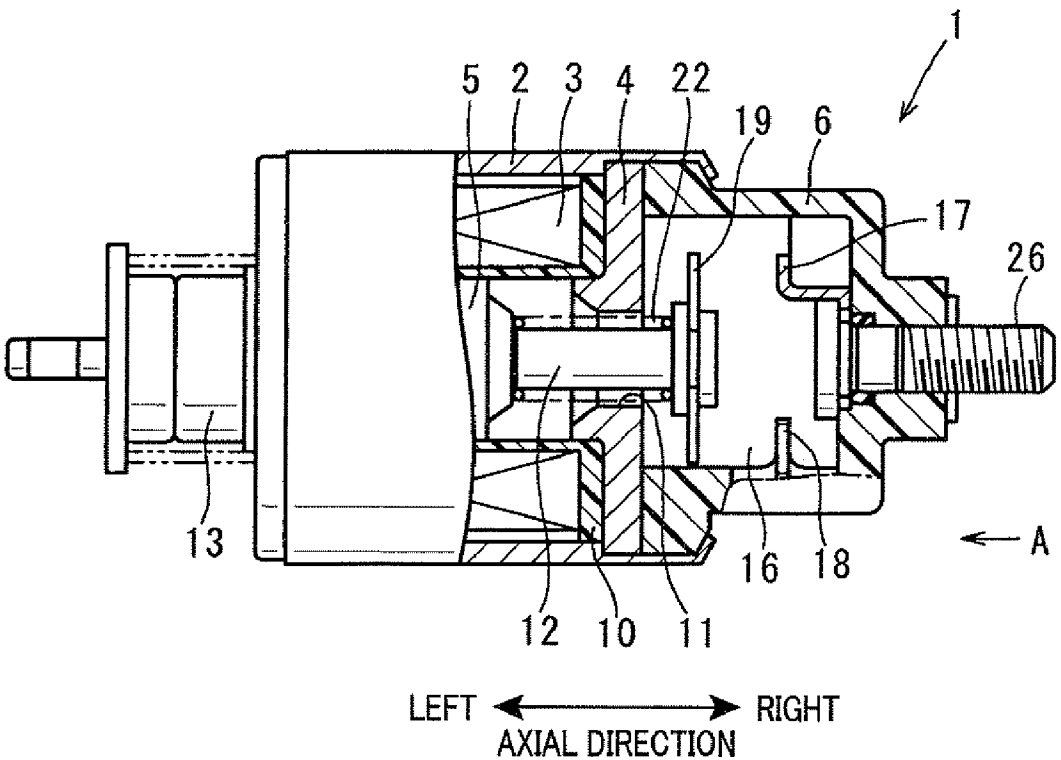
FIG. 1A is a partially cross-sectional schematic view illustrating the overall configuration of an electromagnetic switch according an embodiment of the invention.

Moreover, as shown in FIGS. 1A and 1B, the movable contact 19 has the shape of a plate extending perpendicular to the shaft 12 on both the upper and lower sides of the shaft 12. The upper part of the movable contact 19 makes up a first contacting portion 23 for making contact with the first fixed contact 17, while the lower part of the movable contact 19 makes up a second contacting portion 24 for making contact with the second fixed contact 18.

The first fixed contact 17 is completely received in the contact chamber 16 and has the shape of a plate that is bent twice to have first and second end portions. Both the first and second end portions extend perpendicular to the axial direction of the contact cover 6; the first end portion is located radially outside of the second end portion. Moreover, the first end portion faces the first contacting portion 23 of the movable contact 19 in the axial direction. On the other hand, the second end portion is axially sandwiched between the bottom wall of the contact cover 6 and a head portion of a terminal bolt 26 that is partially insert-molded in the contact cover 6. In addition, though not shown in FIGS. 1A and 1B, to a right end portion of the terminal bolt 26 which protrudes outside of the contact cover 6, a battery cable drawn from the battery 70 is fixed by fastening a nut onto the right end portion. Consequently, the first fixed contact 17 is electrically connected to the battery 70 via the terminal bolt 26 and the battery cable.

The second fixed contact 18 has the shape of a plate that extends perpendicular to the axial direction of the contact cover 6 so as to penetrate the side wall of the contact cover 6. The second fixed contact 18 has first and second end portions. The first end portion is located within the contact chamber 16 so as to face the second contacting portion 24 of the movable contact 19 in the axial direction. On the other hand, the second end portion is located outside of the contact cover 6 and inserted in a housing (not shown) of the motor 80 so as to be electrically connected to a positive brush (not shown) of the motor 80. That is, the second fixed contact 18 is electrically connected to the motor 80.

With the above arrangement of the fixed and movable contacts 17-19, when the first and second contacting portions 23 and 24 of the movable contact 19 respectively make contact with the first and second fixed contacts 17 and 18, the main contacts of the motor circuit are closed so that electric power is supplied from the battery 70 to the motor 80. In contrast, when the first and second contacting portions 23 and 24 of the movable contact 19 are respectively detached from the first and second fixed contacts 17 and 18, the main contacts of the motor circuit are opened so that the supply of electric power from the battery 70 to the motor 80 is interrupted.

Next, the outstanding features of the electromagnetic switch 1 according to the present embodiment will be described.

Figure 4:
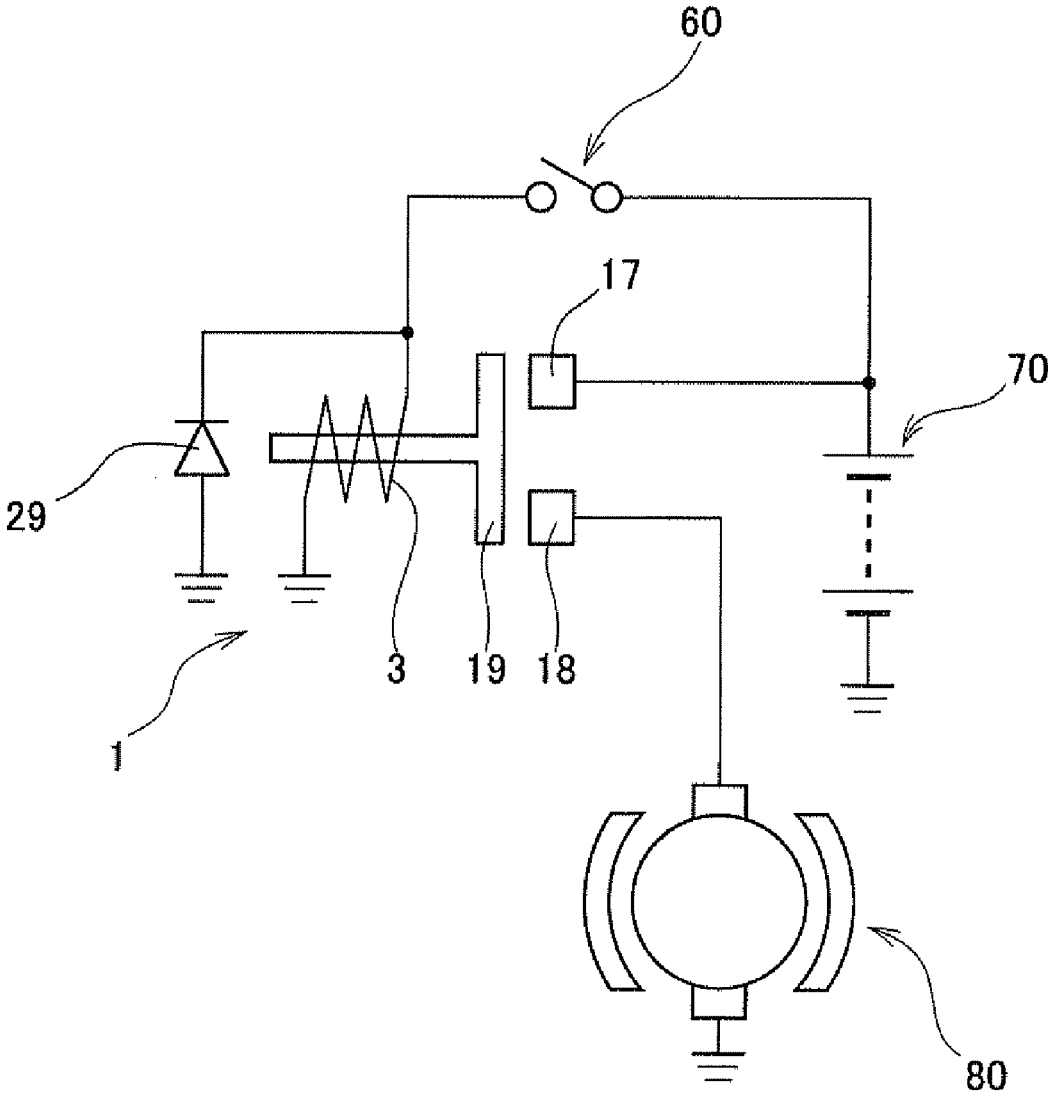
FIG. 4 is a schematic circuit diagram illustrating the electric connection between the electromagnetic coil and the diode.

In the present embodiment, the electromagnetic switch 1 further includes a diode 29 that is electrically connected in parallel with the electromagnetic coil 3 (see FIG. 4).

Figure 2B:
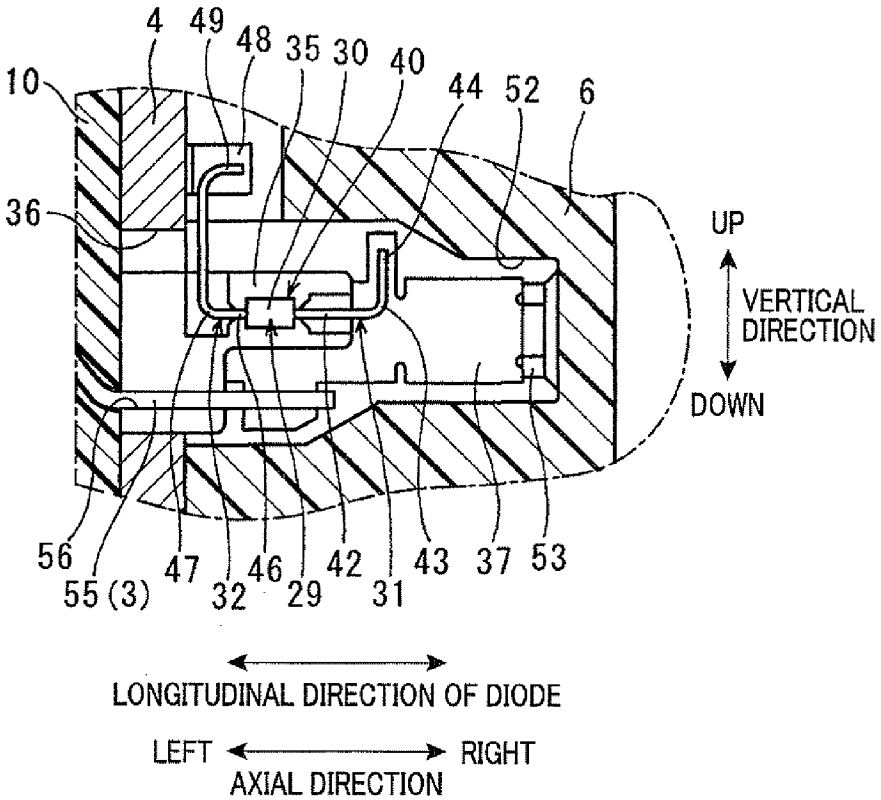
FIG. 2B is a cross-sectional view illustrating the arrangement of an electromagnetic coil and a diode in the electromagnetic switch.
Figure 2A:
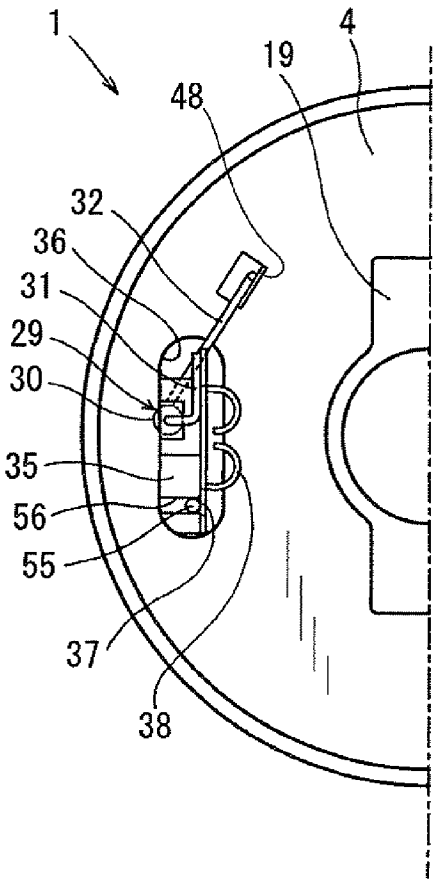
FIG. 2A is an enlarged view of part of FIG. 1B.

FIG. 1B is an end view of the electromagnetic switch 1 in the A direction of FIG. 1A, wherein the contact cover 6 is omitted for showing the diode 29. FIG. 2A is an enlarged view of the left half of FIG. 1B. FIG. 2B is a cross-sectional view showing the arrangement of the electromagnetic coil 3 and the diode 29 in the electromagnetic switch 1. In addition, it should be noted that the diode 29 is arranged on the front side of the paper surface of FIG. 1A and thus cannot be seen from FIG. 1A.

As shown in FIG. 2B, the diode 29 includes a main body 30 and has a pair of leads 31 and 32 that are respectively arranged on opposite sides of the main body 30 in a lead arrangement direction of the diode 29 and respectively extend from a pair of ends of the main body 30 which are opposite to each other in the lead arrangement direction.

More specifically, in the present embodiment, the lead arrangement direction coincides with the longitudinal direction of the main body 30 of the diode 29. Further, the diode 29 is disposed in the electromagnetic switch 1 so that the longitudinal direction of the main body 30 is parallel to the movement direction of the movable core 5. In addition, the movement direction of the movable core 5 coincides with the axial direction of the switch case 2 (or the contact cover 6) which is indicated in FIGS. 1A and 2B.

Figure 3:
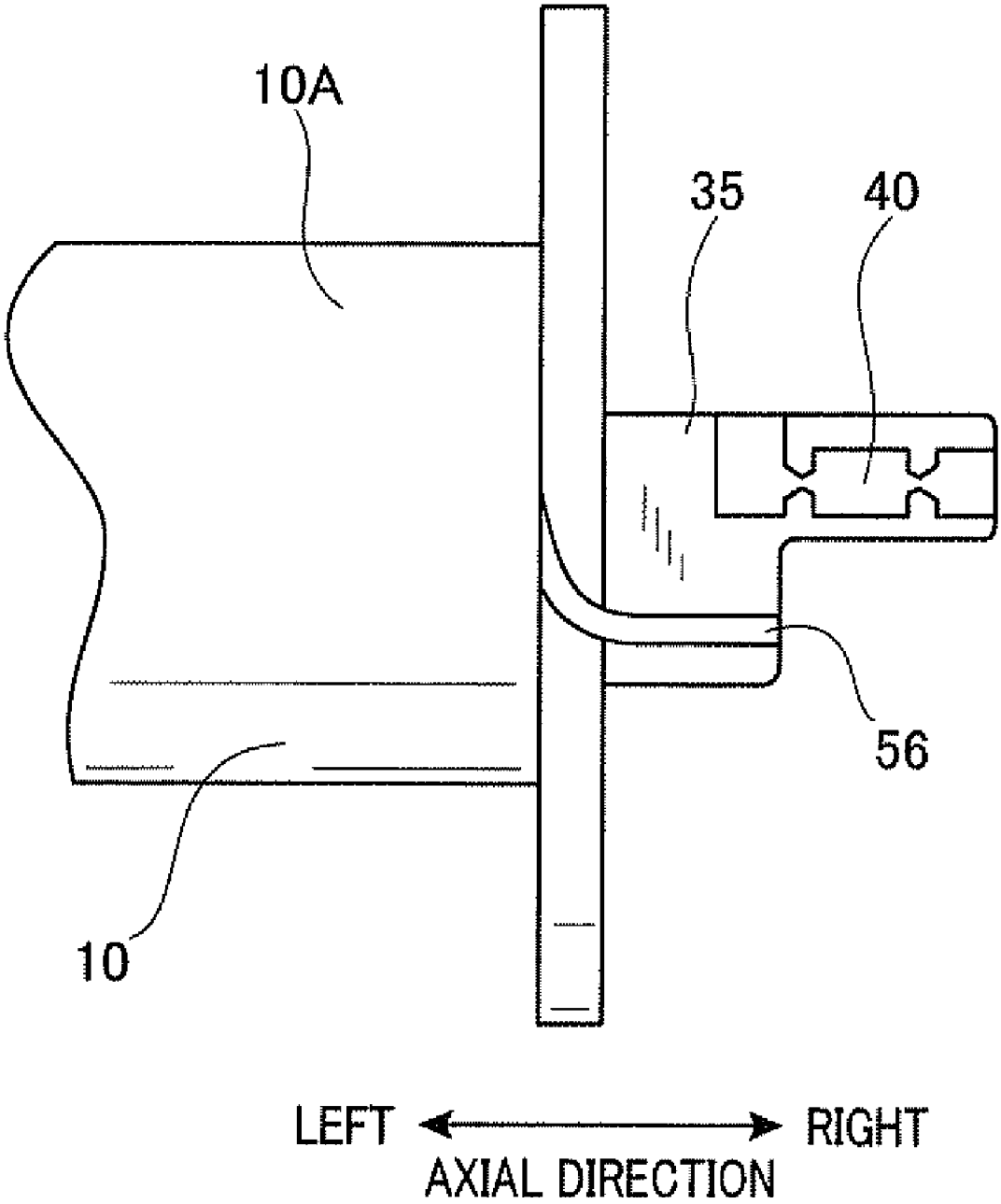
FIG. 3 is a plan view of part of a bobbin of the electromagnetic switch.

Moreover, in the present embodiment, as shown in FIGS. 3 and 2B, the bobbin 10 includes a main body 10A, around which the electromagnetic coil 3 is wound, and a diode mounting portion 35 which extends from the main body 10A rightward and to which the diode 29 is mounted.

More specifically, the main body 10A of the bobbin 10 is disposed on the left side of the fixed core 4 so that a right end face of the main body 10A abuts a left end face of the fixed core 4. The fixed core 4 has a through-hole 36 that is formed to penetrate the fixed core 4 in the thickness direction of the fixed core 4 (i.e., the axial direction shown in FIG. 2B), The diode mounting portion 35 extends rightward from the right end face of the main body 10A to the right side of the fixed core 4 through the through-hole 36 of the fixed core 4.

In other words, the diode mounting portion 35 protrudes from the main body 10A of the bobbin 10 to the right side of the fixed core 4. Further, as shown in FIG. 2A, the diode mounting portion 35 is positioned so as not to interfere with the movable contact 19.

Furthermore, as shown in FIG. 2B, to the back surface of the diode mounting portion 35, there is fixed an electric conductor plate 37 that protrudes further rightward from the diode mounting portion 35. The electric conductor plate 37 is made of, for example, brass. Moreover, the electric conductor plate 37 has a connector portion 38 on its back side.

Referring to FIGS. 2B and 3, the diode mounting portion 35 of the bobbin 10 has a rectangular recess 40 that is formed in the front surface of the diode mounting portion 35 with the longitudinal direction of the recess 40 coinciding with the axial direction of the switch case 2. The main body 30 of the diode 29 is received in the recess 40 of the diode mounting portion 35 and fixed to the diode mounting portion 35.

The diode 29 has a cathode terminal at the right end of the main body 30 and an anode terminal at the left end of the main body 30. The leads 31 and 32 are respectively connected to the cathode and anode terminals of the diode 29.

The lead 31 has a straight portion 42, an L-shaped bent portion 43, and a fixed portion 44. The straight portion 42 is connected to the cathode terminal of the diode 29 and extends rightward from the right end of the main body 30 of the diode 29. The bent portion 43 extends from the straight portion 42 and is bent at a right angle upward. The fixed portion 44 extends from the bent portion 43 further upward and has its distal end fixed to the electric conductor plate 37. That is, the lead 31 is electrically connected to the electric conductor plate 37.

The lead 32 has a straight portion 46, an L-shaped bent portion 47, and a fixed portion 49. The straight portion 46 is connected to the anode terminal of the diode 29 and extends leftward from the left end of the main body 30 of the diode 29. The bent portion 47 extends from the straight portion 46 and is bent at a right angle upward. The fixed portion 49 extends from the bent portion 47 further upward and has its distal end fixed to an electric conductor plate 48. That is, the lead 32 is electrically connected to the electric conductor plate 48.

The electric conductor plate 48 is fixed to the fixed core 4. In addition, in the present embodiment, as shown in FIG. 2A, the electric conductor plate 48 is located radially inner than the diode 29. Therefore, the bent portion 47 of the lead 32 is bent both upward and radially inward.

The contact cover 6 has a recess 52 formed therein for receiving the diode mounting portion 35 of the bobbin 10 and the electric conductor plates 37 and 48. A connector 53 also protrudes into the recess 52 so as to be connected to the connector portion 38 of the electric conductor plate 37. The connector 53 is electrically connected to the battery 70 via the coil energization switch 60.

Consequently, the electric conductor plate 37 is also electrically connected to the battery 70 via the coil energization switch 60.

On the other hand, the electric conductor plate 48 is electrically connected to the fixed core 4. The fixed core 4 is grounded via the switch case 2. Consequently, the electric conductor plate 48 is also grounded via the switch case 2.

As shown in FIG. 2B, the electromagnetic coil 3 has an end 55 that is drawn from the bobbin 10 rightward, passes through a groove 56 formed in the front surface of the diode mounting portion 35, and fixed and thereby electrically connected to the electric conductor plate 37. In addition, the end 55 of the electromagnetic coil 3 is drawn on the lower side of the diode 29 and fixed to a lower part of the electric conductor plate 37.

The other end (not shown) of the electromagnetic coil 3 is grounded via the switch case 2.

As described above, in the present embodiment, the diode 29 is electrically connected in parallel with the electromagnetic coil 3, with the lead 31 and the end 55 of the electromagnetic coil 3 to be higher in electric potential than the lead 32 and the other end of the electromagnetic coil 3.

Consequently, when the coil energization switch 60 is opened and thus the energization of the electromagnetic coil 3 is interrupted, at least part of the electric current, which is caused by the inductance of the electromagnetic coil 3, can be made to circulate within a closed circuit formed by the electromagnetic coil 3 and the diode 29, thereby minimizing the amount of the electric current flowing to the coil energization switch 60.

After having described the configuration and outstanding features of the electromagnetic switch 1, operation thereof will be described hereinafter with reference to FIGS. 1A and 4.

When the coil energization switch 60 is turned on, the electromagnetic coil 3 is energized to form the electromagnet, which magnetizes the fixed core 4. Then, the magnetized fixed core 4 attracts the movable core 5 to move rightward against the urging force of the return spring. With the rightward movement of the movable core 5, the shaft 12 fixed to the movable core 5 is also moved rightward, thereby bringing the movable contact 19 mounted to the shaft 12 into contact with both the first and second fixed contacts 17 and 18. After that, the movable contact 19 is further moved rightward compressing the spring 22, until making contact with the left end of the fixed core 4. Consequently, the movable contact 19 is pressed against the first and second fixed contacts 17 and 18 by the compressive load of the spring 22, thereby bridging or electrically connecting the fixed contacts 17 and 18. As a result, the main contacts of the motor circuit are closed so that electric power is supplied from the battery 70 to the motor 80.

In addition, it should be noted that when the movable core 5 makes contact with the fixed core 4, a mechanical shock is applied to both the fixed core 4 and the diode 29.

Further, when the coil energization switch 60 is turned off, the energization of the electromagnetic coil 3 is interrupted, thereby demagnetizing the fixed core 4. Then, without the magnetic attraction of the fixed core 4, the movable core 5 is moved leftward by the urging force of the return spring to return to the initial rest position thereof. With the leftward movement of the movable core 5, the shaft 12 is also moved leftward, thereby detaching the movable contact 19 from both the first and second fixed contacts 17 and 18. Consequently, the first and second fixed contacts 17 and 18 are electrically disconnected, and thus the main contacts of the motor circuit are opened. As a result, the supply of electric power from the battery 70 to the motor 80 is interrupted.

In addition, it should be noted that when the energization of the electromagnetic coil 3 is interrupted, at least part of the electric current, which is caused by the inductance of the electromagnetic coil 3, will circulate within the closed circuit formed by the electromagnetic coil 3 and the diode 29, thereby minimizing the amount of the electric current flowing to the coil energization switch 60.

Moreover, during the operation of the electromagnetic switch 1, the shift rod 13 is also moved along with the movable core 5, thereby driving the shift lever to shift the pinion gear into mesh with the ring gear of the engine.

The above-described electromagnetic switch 1 according to the present embodiment has the following advantages.

In the present embodiment, the electromagnetic switch 1 includes: the electromagnetic coil 3 that forms the electromagnet when energized (or supplied with electric power); the fixed core 4 arranged to be magnetized by the electromagnet; the movable core 5 arranged to be attracted by the magnetized fixed core 4 to move in the movement direction thereof toward the fixed core 4; and the diode 29 that is electrically connected in parallel with the electromagnetic coil 3. The diode 29 includes the main body 30 and has the leads 31 and 32 that are respectively arranged on opposite sides of the main body 30 in the lead arrangement direction (i.e., the longitudinal direction in the present embodiment) of the diode 29 and respectively extend from the right and left ends of the main body 30 which are opposite to each other in the lead arrangement direction. Furthermore, the lead arrangement direction of the diode 29 is parallel to the movement direction of the movable core 5.

With the above configuration, when the movable core 5 makes contact with the fixed core 4 and thereby causes a mechanical shock to be applied to the diode 29, the load imposed on the main body 30 of the diode 29 and the leads 31 and 32 due to the mechanical shock will be small. Consequently, it is possible to reliably prevent the diode 29 from being damaged by the mechanical shock.

In comparison, if the lead arrangement direction of the diode 29 is perpendicular to the movement direction of the movable core 5, the load imposed on the main body 30 and the leads 31 and 32 due to the mechanical shock would be large. Consequently, in the worst case, the leads 31 and 32 would be detached from the main body 30 of the diode 29, thereby breaking the electrical connection between the diode 29 and the electromagnetic coil 3.

Moreover, in the present embodiment, the bobbin 10 includes the main body 10A, around which the electromagnetic coil 3 is wound, and the diode mounting portion 35 to which the diode 29 is mounted. In other words, both the electromagnetic coil 3 and the diode 29 are mounted on the same component of the electromagnetic switch 1.

Consequently, it is possible to reduce relative vibration between the electromagnetic coil 3 and the diode 29, thereby reducing the load imposed on the main body 30 of the diode 29 and the leads 31 and 32 due to the relative vibration. As a result, it is possible to prevent the diode 29 from being damaged by the relative vibration.

Further, in the present embodiment, the main body 10A of the bobbin 10 is arranged on the left side of the fixed core 4 in abutment with the fixed core 4. The fixed core 4 has the through-hole 36 that is formed to penetrate the fixed core 4 in the movement direction of the movable core 5 (i.e., in the thickness direction of the fixed core 4 or in the axial direction). The diode mounting portion 35 of the bobbin 10 is formed to extend in the movement direction of the movable core 5 from the main body 10A of the bobbin 10 to the right side of the fixed core 4 through the through-hole 36 of the fixed core 4.

With the above configuration, it is possible to minimize the overall axial length of the electromagnetic switch 1. Moreover, it is also possible to arrange the diode mounting portion 35 of the bobbin 10 in the vicinity of the fixed core 4, thereby allowing the leads 31 and 32 to be fixed to the fixed core 4.

In the present embodiment, the fixed core 4 is fixed between the bobbin 10 and the contact cover 6 (see FIG. 1). That is, the diode mounting portion 35 of the bobbin 10 is fixed to the fixed core 4. Moreover, the electric conductor plate 37 is fixed to the diode mounting portion 35 of the bobbin 10, and thus fixed to the fixed core 4 via the diode mounting portion 35. The electric conductor plate 48 is directly fixed to the fixed core 4. The lead 31 has one end fixed to the diode mounting portion 35 of the bobbin 10 via the main body 30 of the diode 29, and the other end fixed to the electric conductor plate 37. The lead 32 has one end fixed to the diode mounting portion 35 of the bobbin 10 via the main body 30 of the diode 29, and the other end fixed to the electric conductor plate 48.

Consequently, both the leads 31 and 32 are fixed to the fixed core 4. As a result, it is possible to reduce relative vibration between the leads 31 and 32 and the fixed core 4, thereby reducing the load imposed on the leads 31 and 32 due to the relative vibration.

Further, in the present embodiment, the lead 31 has the bent portion 43, which is bent from the lead arrangement direction of the diode 29 (i.e., the horizontal direction in FIG. 2B) upward, and the fixed portion 44 that is fixed to the fixed core 4 via the electric conductor plate 37 and the bobbin 10. On the other hand, the lead 32 has the bent portion 47, which is bent from the lead arrangement direction of the diode 29 upward, and the fixed portion 49 that is fixed to the fixed core 4 via the electric conductor plate 48.

With the above configuration, the fixed portions 44 and 49 of the leads 31 and 32 are out of alignment with the main body 30 of the diode 29 in the lead arrangement direction of the diode 29 (or in the movement direction of the movable core 5). Consequently, when a mechanical shock, which is caused by movement of the movable core 5, is applied to the main body 30 of the diode 29 in the lead arrangement direction of the diode 29, it is possible to absorb the mechanical shock at the bent portions 43 and 47 of the leads 31 and 32, thereby preventing the mechanical shock from being directly transmitted to the fixed portions 44 and 49. As a result, it is possible to reliably prevent the fixed portions 44 and 49 of the leads 31 and 32 from being detached from the electric conductor plates 37 and 48. In other words, it is possible to reliably keep the fixed portions 44 and 49 of the leads 31 and 32 fixed to the fixed core 4.

While the above particular embodiment of the present invention has been shown and described, it will be understood by those skilled in the art that various modifications, changes, and improvements may be made without departing from the spirit of the invention.

For example, in the previous embodiment, the electromagnetic switch 1 includes the single movable core 5 and the single electromagnetic coil 3 for driving the movable core 5. However, the invention can also be applied to an electromagnetic switch in which two movable cores are respectively driven by two electromagnetic coils (see, for example, Japanese Patent Application Publication No. 2010-230013).

What is claimed is:

1. An electromagnetic switch comprising:

an electromagnetic coil configured to form an electromagnet when energized;

a fixed core arranged to be magnetized by the electromagnet;

a movable core arranged to be attracted by the magnetized fixed core to move in a movement direction toward the fixed core; and a diode electrically connected in parallel with the electromagnetic coil, wherein the diode includes a main body and has a pair of leads, each lead having a straight portion respectively extending from a pair of ends of the main body which are opposite to each other in a lead arrangement direction of the diode, and the lead arrangement direction of the diode is parallel to the movement direction of the movable contact.

2. The electromagnetic switch as set forth in claim 1, further comprising a bobbin that includes a main body, around which the electromagnetic coil is wound, and a diode mounting portion to which the diode is mounted.

3. The electromagnetic switch as set forth in claim 2, wherein the main body of the bobbin is arranged, on one side of the fixed core in the movement direction of the movable core, in abutment with the fixed core, the fixed core has a through-hole that is formed to penetrate the fixed core in the movement direction of the movable core, and the diode mounting portion of the bobbin is formed to extend in the movement direction of the movable core from the main body of the bobbin to the other side of the fixed core through the through-hole of the fixed core.

4. The electromagnetic switch as set forth in claim 3, wherein at least one of the leads is fixed to the movable core.

5. The electromagnetic switch as set forth in claim 4, wherein both the leads are fixed to the movable core, and each of the leads has a bent portion, which is bent from the lead arrangement direction of the diode to a direction perpendicular to the lead arrangement direction, and a fixed portion that extends from the bent portion and is fixed to the fixed core.

* * * * *